US005265894A

United States Patent [19]

Dunn

[11] Patent Number: 5,265,894

[45] Date of Patent: Nov. 30, 1993

[54] WHEELED COVER FOR GOLF BAG OR THE LIKE

[75] Inventor: Steven B. Dunn, Santa Ana, Calif.

[73] Assignee: Bullet Golf Ball, Inc., Santa Ana, Calif.

[21] Appl. No.: 25,680

[22] Filed: Mar. 3, 1993

[51] Int. Cl.[5] ..... B62B 1/00

[52] U.S. Cl. ..... 280/47.26; 280/DIG. 6; 150/159; 206/315.4; D34/15

[58] Field of Search ..... 280/47.26, DIG. 6, 47.18; 150/159; 206/315.4; D3/37; D34/15; 190/18 A, 107; 248/96, 98

[56] References Cited

U.S. PATENT DOCUMENTS

| | | | |
|---|---|---|---|
| D. 223,222 | 3/1972 | Christen, Jr. | D3/37 |
| D. 282,303 | 1/1986 | Jessen | D34/15 |
| D. 319,346 | 8/1991 | Jessen | D3/37 |
| 1,581,061 | 4/1926 | Johnston | 280/47.26 |
| 2,597,294 | 5/1952 | Connor | 280/47.26 |
| 2,907,364 | 10/1959 | Trenery | 280/DIG. 6 X |
| 3,316,951 | 5/1967 | Jacobson | 206/315.4 X |
| 3,530,919 | 9/1970 | May | 206/315.4 |
| 4,012,051 | 3/1977 | Embinder . | |
| 4,657,135 | 4/1987 | Kjose . | |
| 4,911,465 | 3/1990 | Hauer . | |
| 4,953,768 | 9/1990 | Muse | 150/159 X |

FOREIGN PATENT DOCUMENTS

| | | | |
|---|---|---|---|
| 0292131 | 7/1991 | Fed. Rep. of Germany | 280/47.26 |

*Primary Examiner*—Brian L. Johnson
*Attorney, Agent, or Firm*—Edward A. Sokolski

[57] ABSTRACT

A cover for enclosing and supporting a bag such as a golf bag and including a pouch for containing golf equipment. This cover is of a collapsible nature for easy and convenient storage and handling as compared with rigid covers, having pliant front rear, side, and top portions. The bottom of the cover has a rigid base with wheels mounted therein. An opening is provided in the cover to permit the insertion of a bag therein, this opening being closable by a suitable device such as a zipper. A handle is mounted on the bag to permit the user to roll the bag along on the wheels. When the bag is not in use, the side, front, rear and top portions can be folded down onto the base to make the cover compact for stowage.

7 Claims, 2 Drawing Sheets

WHEELED COVER FOR GOLF BAG OR THE LIKE

BACKGROUND OF THE INVENTION

1. Field of the Invention

This invention relates to covers for containing golf bags or the like and more particularly to such a cover which has wheels mounted in the base thereof to facilitate transportation and which is collapsible onto such base for stowage.

2. Description of the Prior Art

Various devices have been developed in the prior art to facilitate the transportation of golf clubs. These generally take the form of golf bags which have wheels attached thereto and are rigid or semi-rigid. Such bags are described in U.S. Pat. No. 4,911,465 issued Mar. 27, 1990 to Hauer and U.S. Pat. No. 4,012,051 issued Mar. 15, 1977 to Embinder. Both of these bags have compartments for holding the various golf clubs in a set and are not collapsible. U.S. Pat. No. 4,657,135 issued Apr. 14, 1987 to Kjose describes a rigid or semi-rigid golf bag and container which is placed within a zippered flexible covering for transportation.

While certain of the prior art devices described above are suitable for transportation when traveling, the covers are integrated with particular types of bags and are not suitable for transporting the type of bag which the user may normally use. A golfer often has a preference for a particular type of golf bag and may prefer to continue using the bag of his choice. Even if the golfer were willing to sacrifice the use of his preferred bag when traveling, it is inexpedient to have two bags, one for home use and one for traveling.

The cover of the present invention obviates the shortcomings of prior art golf bag covers and travel bags by providing a cover which can be universally used to transport any type of conventional golf bag (or other such device). The cover of the present invention fully contains the golf bag so that the golf clubs cannot fall out. Further, such cover has a rigid base with wheels installed therein to facilitate transportation. Except for the base, the cover is flexible so that it can be readily folded into a small package for stowage.

SUMMARY OF THE INVENTION

The cover of the present invention has a rigid base with wheels installed therein. The sides, front, rear, and top of the cover are fabricated of a flexible material so that the cover is collapsible onto the base into a small package for stowage. A zipper is provided along one of the sides and top of the cover to facilitate opening and closing of the cover. A golf bag can be placed within the cover with its base resting on the base of the cover and the bag zippered up to fully contain the bag within the cover. A handle and a carrying strap are provided on one of the sides of the cover to facilitate wheeling or carrying of the bag as may be desired.

It is therefore an object of this invention to facilitate the transportation of a golf bag or the like.

It is a further object of this invention to provide an improved golf bag cover which can be used to wheel such a bag and which can be collapsed into a small package for stowage.

Other objects of the invention will become apparent as the description proceeds in connection with the accompanying drawings.

DETAILED DESCRIPTION OF THE INVENTION

Figure 1:
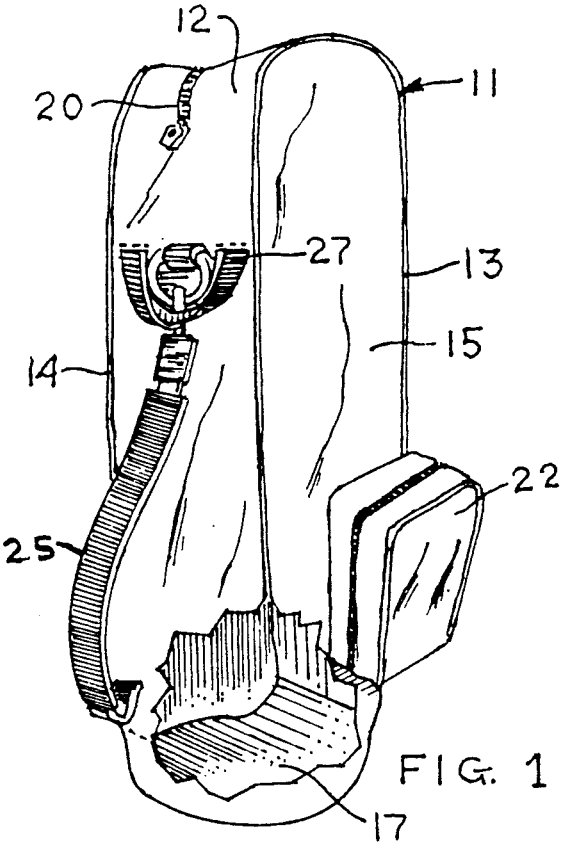
FIG. 1 is a front perspective view with a partial cutaway section of a preferred embodiment of the invention.
Figure 2:
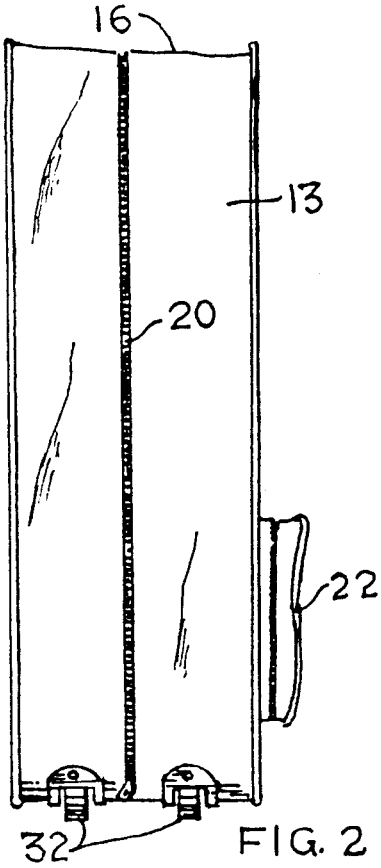
FIG. 2 is a rear elevational view of the preferred embodiment.

Referring now to the drawings, a preferred embodiment of the invention is illustrated. Cover 11 is elongated and has a generally rectangular shape having opposing front and rear portions 12 and 13, opposing side portions 14 and 15 and a top portion 16, all of which are of a flexible material such as canvas or a suitable plastic. Bottom portion 17 is rigid and may be of a suitable plastic such as polyurethane board.

Side 13 is made of two similar pieces **13*a* and 13*b* while top 16 is made of two similar pieces 16*a* and 16*b*, these pieces being joined together to close the bag by means of zipper 20 which forms closure means. A zippered pouch 22 is formed on side 15 for containing miscellaneous objects such as golf balls, tees, etc. A flexible cloth carrying strap 25 is attached to the front portion 12, and a flexible cloth handle 27 is attached to front portion 12 adjacent to the top end of the carrying strap. Wheels 32 are installed in the rear part of base portion 17**.

Figure 3:
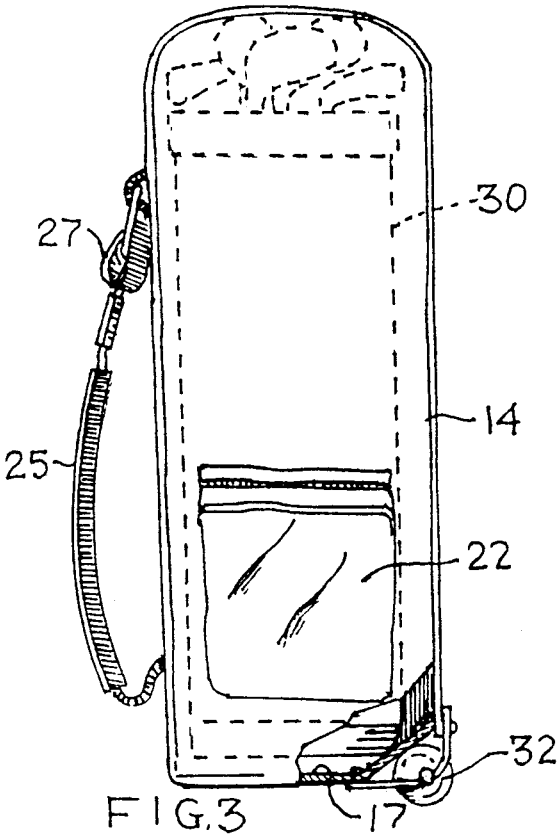
FIG. 3 is a left side elevational view of the preferred embodiment.
Figure 4:
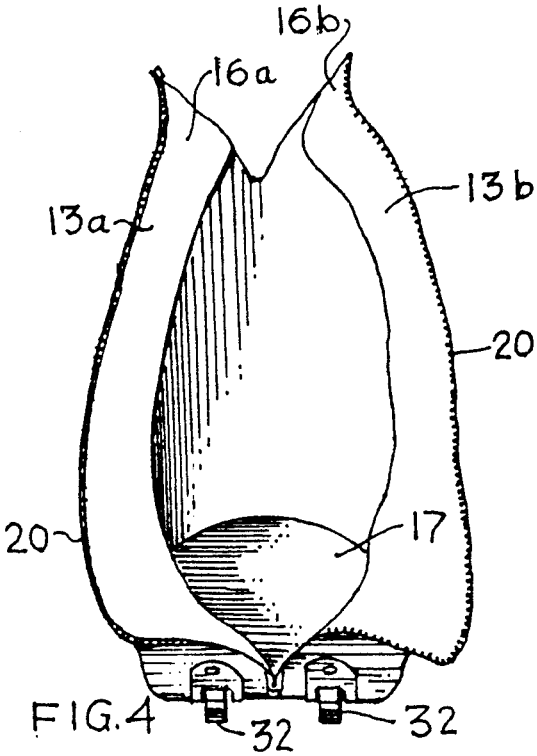
FIG. 4 is a rear elevational view of the preferred embodiment with the zipper opened.

In placing a golf bag, or the like, inside of the cover, zipper 20 is first fully opened as shown in FIG. 4, and the bag 30 to be covered and transported placed within the cover with its bottom resting on rigid bottom portion 17 of the cover. The zipper is then closed to contain the bag 30 within the cover, as shown in FIG. 3. The cover with the golf bag contained therein can be wheeled along on wheels 32 with the user grabbing hold of handle 27.

Figure 5:
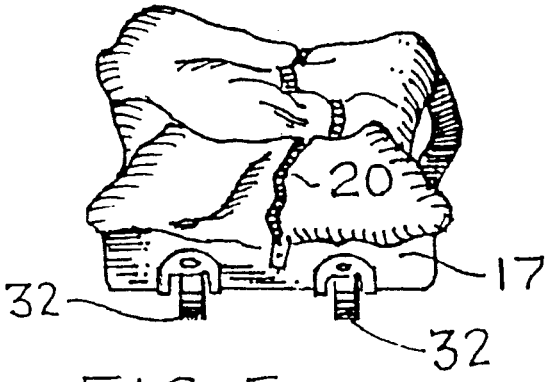
FIG. 5 is a rear perspective view of the preferred embodiment with the cover collapsed.
Figure 6:
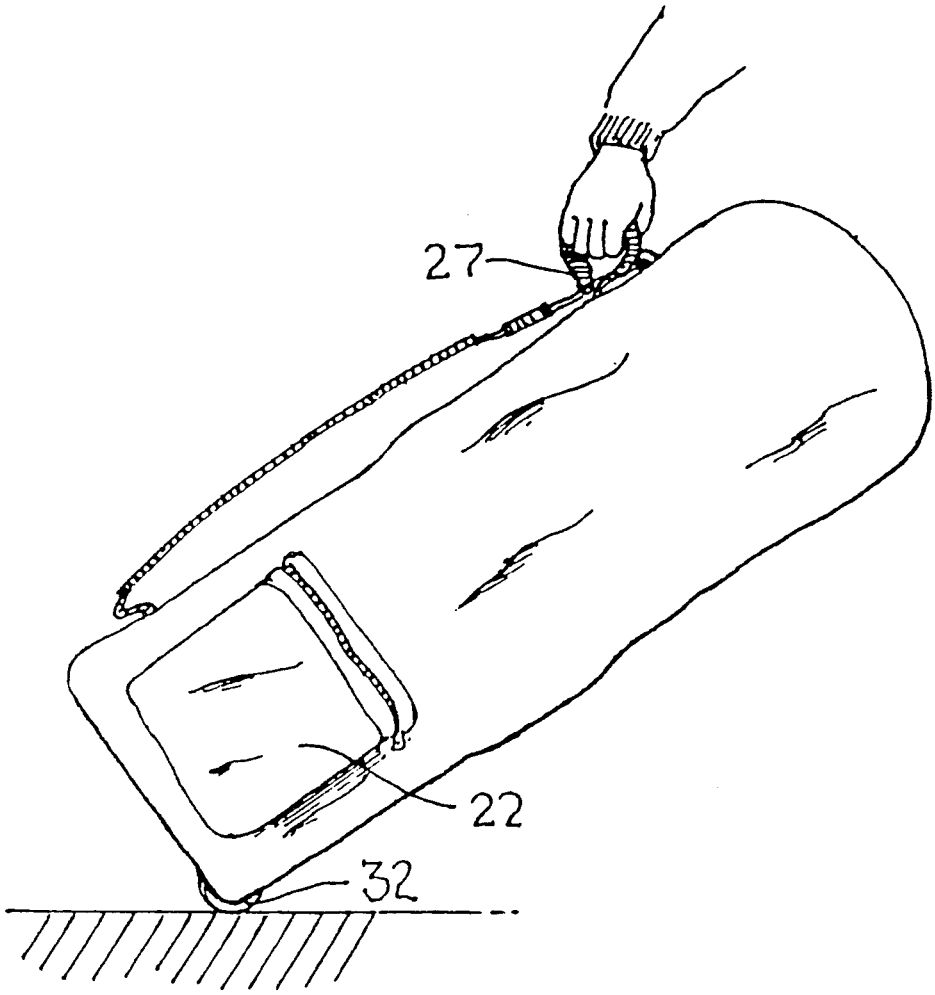
FIG. 6 is a left side elevational view of the preferred embodiment showing the cover and its contents being wheeled along.

The cover is collapsible and, when not in use, can be folded down on the base portion to make for a compact package for stowage as shown in FIG. 5.

While the invention has been described and illustrated in detail it is to be clearly understood that this is intended by way of illustration and example only and is not to be taken by way of limitation, the spirit and scope of the invention being limited only by the terms of the following claims.

I claim:

1. A cover device for covering a bag and transporting said bag comprising:

flexible opposing front and rear portions, flexible opposing side portions and a flexible top portion, a rigid base portion having a substantially smaller surface area than either said front, rear or side portions, said front and rear portions, side portions, top portion, and base portion being joined together to form a container, said top portion and one of said other portions having closure means formed therein for permitting said cover device to be alternatively opened to permit said bag to be placed in or removed from the cover device or closed to completely surround said bag in containment within said cover device, wheel means installed in said base portion, and handle means installed on one of said side, front, or rear cover portions for wheeling said cover device with said bag therein, said cover device being collapsible onto said base portion to form a compact package for stowage when said bag is removed therefrom.

2. The device of claim 1 wherein said closure means comprises a zipper installed in the top portion and one of the side portions of said cover device.

3. The device of claim 1 and additionally including a carrying strap installed on one of said side portions.

4. The device of claim 1 wherein said wheel means comprises a pair of wheels installed at one side of said base portion.

5. A cover device forming a container for a golf bag comprising:

opposing elongated side portions;

opposing elongated front and back portions;

opposing top and bottom portions each having a substantially smaller surface area than either said front, back or side portions;

said side portions, front and back portions and top portion being of a flexible foldable material, said bottom portion being of a rigid material, said side, front and back, and top and bottom portions being joined together to form an enclosed container;

zipper means installed in said device for permitting the enclosed container formed by said device to be opened to permit the placement of a golf bag therein and closed to contain said bag in said container;

wheel means installed on said bottom portion; and a handle attached to said device to facilitate the wheeling of said device on said wheel means;

said side, rear, front and top portions being collapsible onto said bottom portion to form a compact package for stowage when said bag is removed therefrom.

6. The device of claim 5 wherein said wheel means comprises a pair of wheels mounted on one side of said bottom portion.

7. The device of claim 5 and further including a carrying strap installed on one of said side portions.

* * * * *